US006099381A

United States Patent [19]

Sodeshima

[11] Patent Number: 6,099,381

[45] Date of Patent: Aug. 8, 2000

[54] CATCHING TOY AND CATCHING DEVICE

[75] Inventor: Kei Sodeshima, Tokyo, Japan

[73] Assignee: Tomy Company, Ltd., Tokyo, Japan

[21] Appl. No.: 09/161,991

[22] Filed: Sep. 29, 1998

[51] Int. Cl.[7] ..... A63H 33/00; A63B 67/00; A63B 47/02; A01M 23/02; A01M 23/24

[52] U.S. Cl. ..... 446/487; 446/486; 446/365; 446/424; 273/140; 273/447; 43/63; 43/89; 43/93; 294/19.2; 294/110.1

[58] Field of Search ..... 446/156, 361, 446/365, 366, 424, 486, 487; 273/447, 140; 43/63, 89, 92–93; 294/19.2, 19.3, 97, 110.1

[56] References Cited

U.S. PATENT DOCUMENTS

| | | | |
|---|---|---|---|
| 246,240 | 8/1881 | Symonds . | |
| 411,606 | 9/1889 | Parker . | |
| 996,234 | 6/1911 | Fritz . | |
| 1,191,124 | 7/1916 | Cotton . | |
| 1,576,707 | 3/1926 | Bailey . | |
| 1,889,351 | 11/1932 | Cooper . | |
| 2,534,152 | 12/1950 | Van Arkel . | |
| 3,669,427 | 6/1972 | Curtis . | |
| 4,693,473 | 9/1987 | Miller | 294/19.2 |
| 4,936,574 | 6/1990 | Lee | 273/140 |
| 5,607,196 | 3/1997 | Weger . | |
| 5,702,108 | 12/1997 | Todokoro | 273/447 |

FOREIGN PATENT DOCUMENTS

| | | |
|---|---|---|
| 1 381 500 | 1/1975 | United Kingdom . |
| 2 292 330 | 2/1996 | United Kingdom . |

*Primary Examiner*—Robert A. Hafer
*Assistant Examiner*—Laura Fossum
*Attorney, Agent, or Firm*—Nixon & Vanderhye P.C.

[57] ABSTRACT

A catching toy includes a container having a first container body and a second container body which is relatively movable to the first container body. The first and second container bodies are configurable in a first state in which the container is opened and a second state in which the container is closed to form a chamber which is large enough to contain an object to be caught. A biasing member biases the second container body to the second state when the container is in the first stage. An engaging member engages the second container body with the first container body to keep the container in the first state. A releasing member releases an engagement of the first and second container bodies to change the container in the second state, by a contact with the object to be caught so that the object is entrapped in the chamber of the container.

5 Claims, 3 Drawing Sheets

CATCHING TOY AND CATCHING DEVICE

BACKGROUND OF THE INVENTION

1. Field of the Invention

The present invention relates to a catching toy for catching objects such as various kinds of animal dolls or the like, and to a catching device for picking up an object, for example, one existing at a lower position, and the like.

2. Description of the Related Art

A catching toy, has been known were a target having a magnet or a magnetic body is attached to an object to be caught, which has a shape of a fish or the like. Another magnet is attached to the end portion of a line of a rod for catching the object. The object is caught by the magnetic force between the magnet attached to the end portion of the line and the magnet or the magnetic body, which is attached to the object.

With another catching toy, a mouth of an object to be caught, like a hippopotamus or the like, is opened and closed by turns. A bitten member for being bitten by the object, is attached to the end portion of a line of a rod. When the mouth of the object to be caught opens, the bitten member is inserted into the mouth of the object, and then when the mouth of the object closes, the bitten member is pulled up using the rod to catch the object.

The above catching toys, however, have the following problems. In the first catching toy, there is a problem that only the object having a magnet or the like, can be caught. In the second catching toy, there is a problem that only the object of which a mouth is opened and closed by turns, can be caught.

SUMMARY OF THE INVENTION

The present invention was developed in view of these problems.

An object of the present invention is to provide a catching toy which can catch almost any object having a certain size and therefore which can further increase interest in the toy.

Another object of the present invention is to provide a catching device which can catch almost any object having a certain size.

That is, in accordance with one aspect of the present invention, the catching toy includes a container having a first container body and a second container body which is relatively movable to the first container body. The first and second container bodies are configurable in a first state in which the container is opened and a second state in which the container is closed to form a chamber which is large enough to contain an object to be caught. A biasing member biases the second container body to the second state when the container is in the first state. An engaging member engages the second container body with the first container body to keep the container in the first state. A releasing member releases an engagement of the first and second container bodies to change the container in the second state, by contact with the object to be caught, so that the object is entrapped in the chamber of the container.

According to the present invention, because the object to be caught can be entrapped in the chamber of the container when the container is closed, it is not required that a specific artifice, for example, attachment of a magnet, or provision of a structure in which the mouth of an animal toy is opened and closed by turns, is carried out for the object to be caught. Therefore, the catching toy having such a structure, according to the invention can catch almost any object having a certain size and a certain solidity.

Preferably, a pawl hole is formed in one of the first and second container bodies and a pawl is provided on the other of the first and second container bodies which can be engaged with the pawl hole to keep the container in the first state. The releasing member preferably includes a releasing lever for releasing an engagement of the pawl and the pawl hole, to change the container in the second state when the releasing lever is pushed by the object to be caught. The biasing member may comprise a spring.

According to the catching toy having such a structure, when the object to be caught is covered with the container in the first state, i.e., an opened state, the object is brought into contact with the releasing lever and pushes it. As a result, the engagement of the pawl and the pawl hole is released to change the container to the second state, i.e., a closed state, by the biasing force due to the spring. Thus, the object is entrapped in the chamber of the container by the movement of the second container body. According to the above catching toy, it is possible to make the structure simple and to reduce the cost for manufacturing the catching toy.

Preferably, when the container is in the first (opened) state, the first and second container bodies are overlapped. In additional, each of the first and second container bodies preferably has a hemispherical shape which has a diameter different from each other, and the container preferably has an approximately spherical shape when in the second state.

According to the catching toy having such a structure, it is possible to treat the toy like a ball.

An elastic string may be attached to the first container body and a finger fitting portion in which a player's finger can be put may be provided at a free end of the elastic string.

According to the catching toy having such a structure, it is possible to treat the catching toy like a yo-yo. Further, it is possible for a plurality of players to enjoy a game for competing with one another, for example, in number of objects caught from a collection of objects placed on the floor, or the like.

In accordance with another aspect of the present invention, the catching device includes a container having a first container body and a second container body which is relatively movable to the first container body. The first and second container bodies are configurable in a first state in which the container is opened and a second state in which the container is closed to form a chamber which is large enough to contain an object to be caught. A biasing member biases the second container body to the second state when the container is in the first state; an engaging member for engaging the second container body with the first container body to keep the container in the first state. A releasing member releases an engagement of the first and second container bodies to change the container in the second state, by contact with the object to be caught, so that the object is entrapped in the chamber of the container.

According to the catching device of the present invention, because the object to be caught can be entrapped in the chamber of the container when the container is closed, it is not required that a specific artifice, for example, attachment of a magnet, is carried out for the object. Therefore, the catching device having such a structure according to the invention enables catching of almost any object having a certain size and a certain solidity. Such a catching device can be used for picking up an object from a little distance, for example, for picking up a dangerous object from a little distance, for picking up an object existing in a dangerous area such as on a place near a railway, and the like.

Preferably, a stick for handling is attached to the top of the first container body. According to the catching device having such a structure, it is possible to easily catch an object which exists not only at a lower position but also at an upper position.

BRIEF DESCRIPTION OF DRAWINGS

The present invention will become more fully understood from the detailed description given hereinbelow and the accompanying drawings which are given by way of illustration only, and thus are not intended as a definition of the limits of the present invention, and wherein;

FIGS. 3A–3C are views showing a sequence of catching operation of a the catching toy according to the present invention, in which FIG. 3A is a partially sectional view showing a state of throwing the catching toy at the object to be caught, FIG. 3B is a partially sectional view showing a state of covering the object with the catching toy, and FIG. 3C is a partially sectional view showing a state of catching the object.

PREFERRED EMBODIMENT OF THE INVENTION

Figure 1:
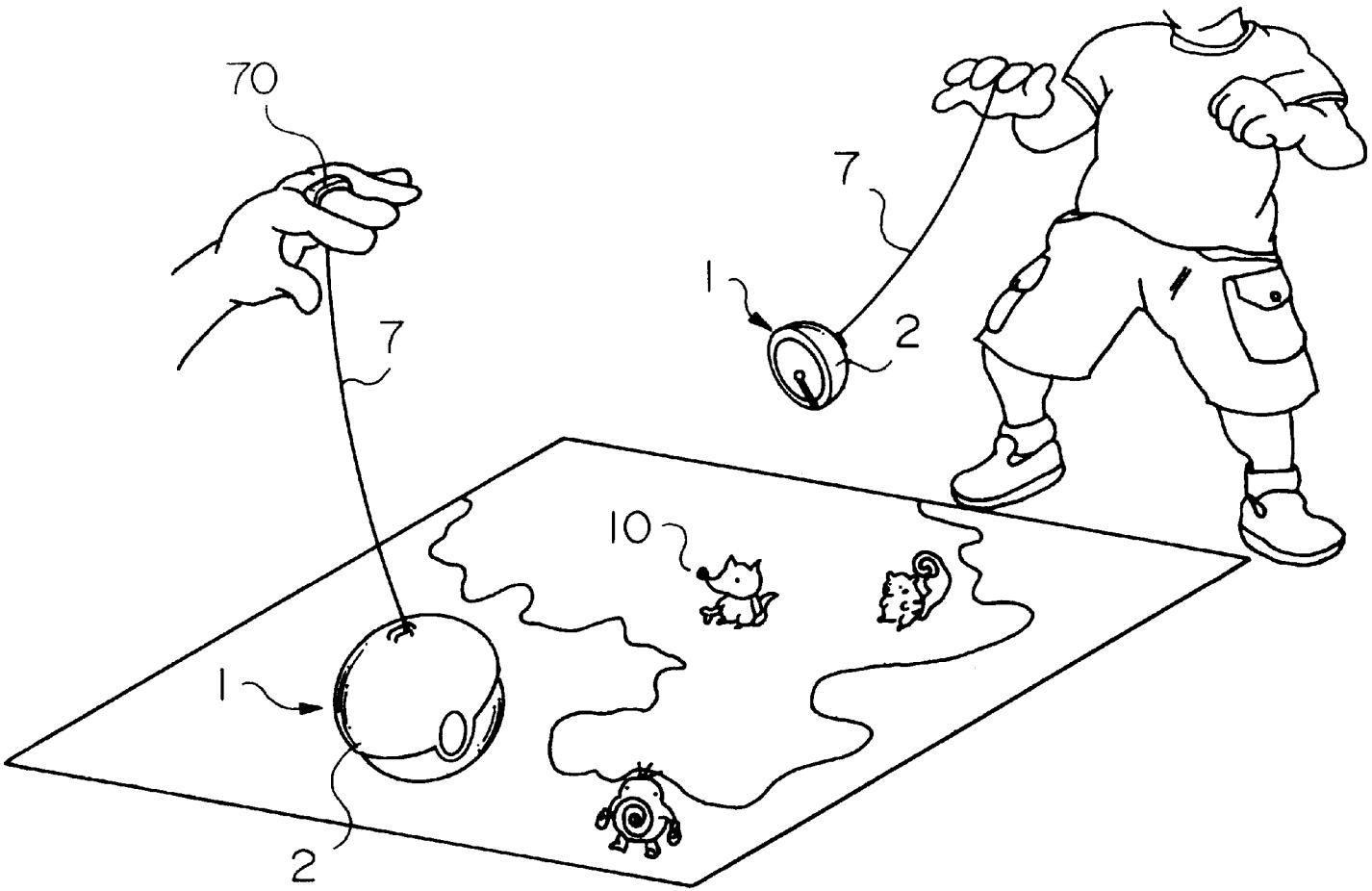
FIG. 1 is a view showing a state in which the catching toy according to the present invention is used.
Figure 2:
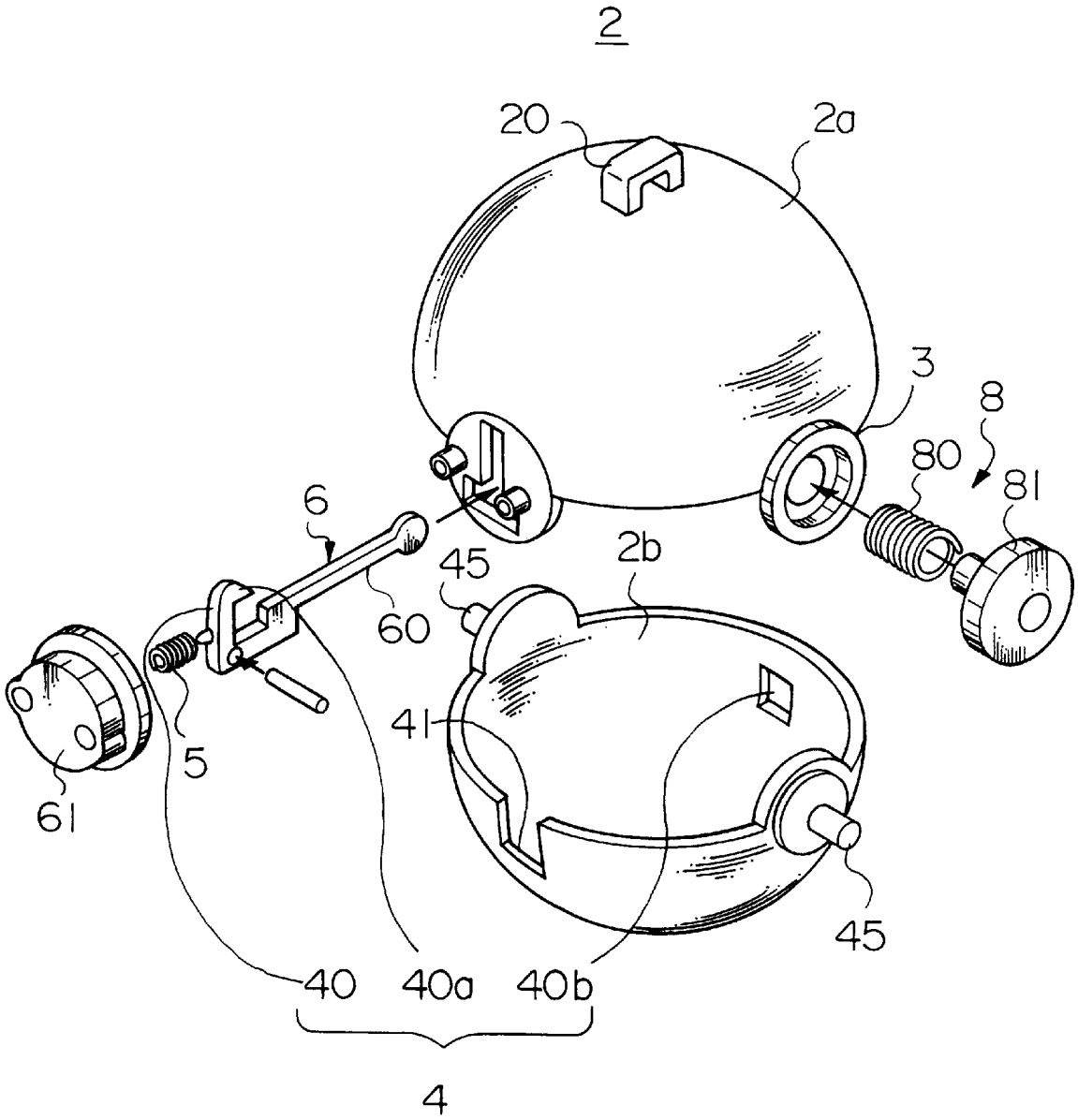
FIG. 2 is an exploded perspective view of the container of the catching toy according to the present invention.

FIG. 1 is a view showing a state in which the catching toy according to the present Invention is used, and FIG. 2 is an exploded perspective view of a principal portion of the catching toy. In these figures, reference numeral 1 denotes the catching toy.

The catching toy 1 comprises a spherical container 2, a biasing member 8, an engaging means 4, and a releasing member 6, as shown in FIG. 2.

Figure 3A:
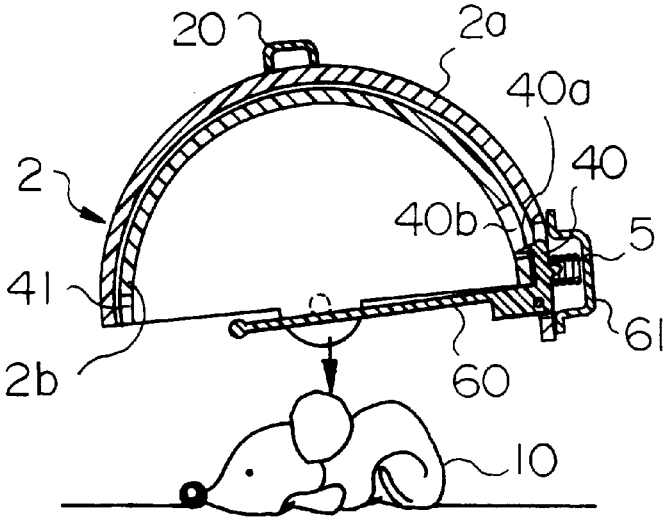
Figure 3B:
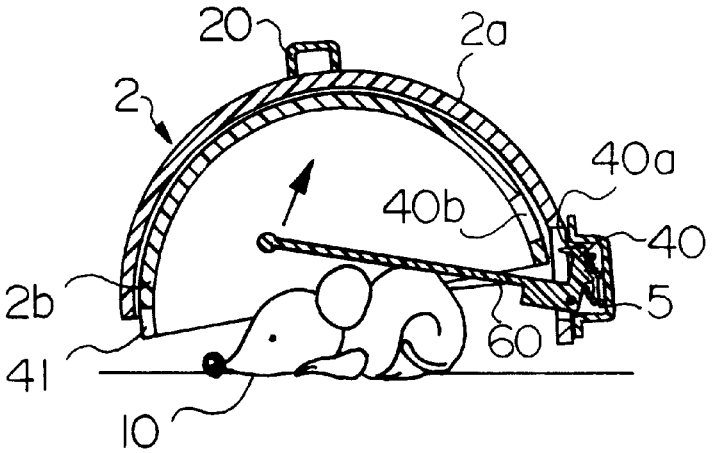
Figure 3C:
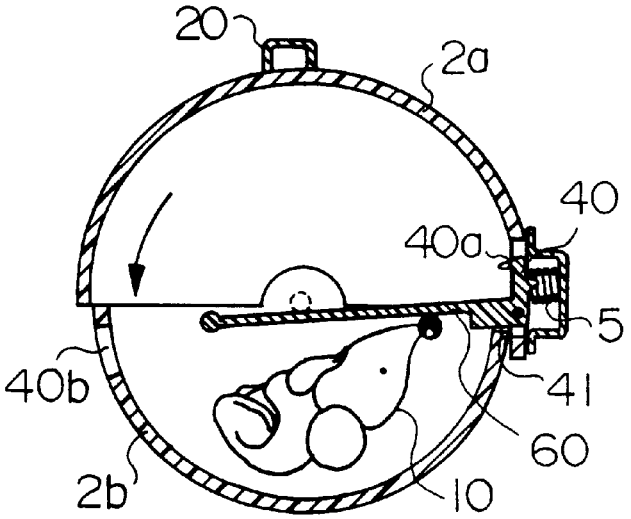

The container 2 comprises a hemispherical first container body 2*a* and a hemispherical second container body 2*b*. The container 2 can make a chamber which is large enough to contain an object 10 to be caught, such as a doll having a shape of an animal, a TV character or the like. In the container 2, a diameter of the first container body 2*a* which composes an upper part of the container 2 is larger than that of the second container body 2*b* which composes a lower part thereof. The second container body 2*b* can be rotated around shafts 45 and 45 which are received by bearing parts 3 and 3 which are attached to the edge portion of the first container body 2*a*. By the rotation of the second container body 2*b*, the container 2 can be configured in a first state in which the container 2 is opened, as shown in FIG. 3A, and a second state in which the container is closed to form a chamber, as shown in FIG. 3C. When the container 2 is completely opened, that is, in a first state, as shown in FIG. 3A, the second container body 2*b* is fit in the first container body 2*a* so as to overlap each other.

The biasing member 8 comprises a torsion coil spring 80 and a cover 81. The torsion coil spring 80 gives a biasing force to the second container body 2*b* in the direction of closing the container 2, that is, toward the second state when the container 2 is in the first state. The cover 81 is for mounting an end of the torsion coil spring 80 to the first container body 2*a* and for covering the torsion coil spring 80.

The engaging means 4 comprises an engaging portion 40 having a pawl 40*a* which is formed at the end thereof, and a pawl hole 40*b* formed at a suitable position to engage with the pawl 40*a* in the second container body 2*b*. The engaging means 4 is for engaging the second container body 2*b* with the first container body 2*a* so as to keep the container 2 in the first state. The releasing member 6 is for releasing the engagement of the first and second container bodies 2*a* and 2*b*. The engaging portion 40 having the pawl 40*a* and the releasing member 6 are formed as a body and are attached to a lower end of the first container body 2*a* to be on the diameter line approximately perpendicular to the shafts 45 and 45 of the second container body 2*b*. These members 4 and 6 can be rotated on a shaft which passes through these members at a position between these members, on the plane including the diameter line. The engaging portion 40 is biased toward engaging the pawl 40*a* with the pawl hole 40*b*, that is, in a counterclockwise direction in FIG. 3A, by a spring 5. Therefore, when the container 2 is in the first state, as shown in FIG. 3A, the pawl 40*a* of the engaging portion 40 is engaged with the pawl hole 40*b*.

Further, in the second container body 2*b*, a notch portion 41 is formed at a position opposite to the pawl hole 40*b*. When the container 2 is closed in the second state, as shown in FIG. 3C, the engaging portion 40 comes into the notch portion 41.

The releasing member 6 comprises a lever 60 which is operated with the engaging portion 40. When the object 10 to be caught such as an animal doll hits the lever 60, the lever 60 is operated to rotate in a clockwise direction against the biasing force of the spring 5, as shown in FIG. 3B. In FIGS. 2 and 3A, reference numeral 61 denotes a cover for covering the engaging portion 40 and the spring 5.

An elastic string 7 such as rubber string is attached to a string attachment part 20 which is formed on the top of the first container body 2*a* of the container 2. The elastic string 7 has a ring-shaped finger fitting portion at a free end of the elastic string for receiving a player's finger.

The method of using the above catching toy 1 will be explained below.

A player puts on the ring 70, for example, on player's middle finger. The container 2 is prepared in the first state, that is, in the opened state. The player loosely holds the upper surface of the first container body 2*a*. The player shakes his/her hand up and down, while the catching toy 1 is held by the hand. when the player shakes his/her arm downwardly, he/she releases the container 2 softly and downwardly. As a result, the container 2 comes to hit on the ground. When an object 10 to be caught exists on the ground and the object 10 is covered with the container 2 luckily, as shown in FIG. 3B, the lever 60 is pushed by the object 10, so that the lever 60 is rotated (in a clockwise direction in FIGS 3A–3C) to release the engagement of the pawl 40*a* and the pawl hole 40*b*. As a result, the second container body 2*b* is rotated by the biasing force of the torsion coil spring 80 to close the container 2 while the object 10 is entrapped in the spherical chamber of the container. Because the second container body 2*b* is operated quickly, the object 10 can be scooped up by the second container body 2*b*, as shown in FIG. 3C.

Although the present invention has been explained according to an embodiment of a catching toy, the present invention is not limited to the embodiment. Any modification may be adopted without departing from the gist thereof.

In the catching toy 1 according to the above embodiment, although only a container 2 having a spherical shape is described, the container 2 may have any shape when the object to be caught can be contained therein.

Further, in the catching toy 1 according to the above embodiment, although a ring 70 is provided at an end of the elastic string 7, a loop may be formed by knotting the end of rubber string 7 in place of the ring 70.

With the structure according to the present invention, the catching toy can catch almost any object without use of a magnetic force.

The present invention can be also applied to a catching device for picking up an object, other than a toy. For example, the invention can be applied to a catching device for picking up an object from a short distance, for picking up a dangerous object from a short distance, for picking up an object existing in a dangerous area such as near a railway, and the like. In these cases, in place of the elastic string 7 attached to the top of the first container body 2*a* of the container 2, a rigid stick having a suitable or changeable length can be used.

According to the catching device of the invention, it is possible to pick up almost any object having a certain size and a certain solidity, from a short distance, without use of a magnetic force. Further, according to the catching device of the invention, it is possible to pick up even a dangerous object or even an object existing in a dangerous area, safely and surely.

The entire disclosure of Japanese Utility Model Application No. Jitsugan hei-9-9452 filed on Oct. 24, 1997 (Japanese Utility Model Registration No. 3,048,342; registered on Feb. 18, 1998) including specification, claims, drawings and summary are incorporated herein by reference in its entirety.

What is claimed is:

1. A catching toy comprising:

a container including a first container body and a second container body which is relatively movable to the first container body, the first and second container bodies being configurable in a first state in which the container is opened and second state in which the container is closed to form a chamber which is large enough to contain an object to be caught;

a biasing member for biasing the second container body in a direction to take the second state when the container is in the first state;

an engaging member for engaging the second container body with the first container body to keep the container in the first state;

a releasing member for releasing an engagement of the first and second container bodies to configure the container in the second state, by a contact with the object to be caught, so that the object is entrapped in the chamber of the container;

an elastic string made of rubber attached to the first container body, the elastic string returning the container to a player by an elasticity thereof after the container is released toward the object to be caught; and a finger fitting portion attached to a free end of the elastic string, the finger fitting portion being shaped to receive a player's finger.

2. A catching toy as claimed in claim 1, wherein the engaging member comprises a pawl hole formed in one of the first and second container bodies and a pawl attached to the other of the first and second container bodies, the pawl being selectively engageable with the pawl hole to keep the container in the first state, and wherein the releasing member comprises a releasing lever for releasing an engagement of the pawl and the pawl hole, to configure the container in the second state when the releasing lever is pushed by the object to be caught.

3. A catching toy as claimed in claim 2, wherein the biasing member comprises a spring.

4. A catching toy as claimed in claim 1, wherein when the container is in the first state, the first and second container bodies are overlapped.

5. A catching toy as claimed in claim 4, wherein each of the first and second container bodies has a hemispherical shape which has a diameter different from each other, and wherein the container has an approximately spherical shape in the second state.

* * * * *